US008317389B2

(12) United States Patent
Jägle

(10) Patent No.: US 8,317,389 B2
(45) Date of Patent: Nov. 27, 2012

(54) MICROTITER PLATE WITH STIRRING ELEMENTS

(75) Inventor: Peter Jägle, Ballrechten-Dottingen (DE)

(73) Assignee: IKA-Werke GmbH & Co. KG, Staufen (DE)

( * ) Notice: Subject to any disclaimer, the term of this patent is extended or adjusted under 35 U.S.C. 154(b) by 685 days.

(21) Appl. No.: 12/308,818

(22) PCT Filed: May 11, 2007

(86) PCT No.: PCT/EP2007/004187

§ 371 (c)(1),
(2), (4) Date: Sep. 25, 2009

(87) PCT Pub. No.: WO2008/000312

PCT Pub. Date: Jan. 3, 2008

(65) Prior Publication Data

US 2010/0034048 A1 Feb. 11, 2010

(30) Foreign Application Priority Data

Jun. 29, 2006 (DE) ..... 10 2006 030 056

(51) Int. Cl.
*B01F 11/04* (2006.01)

(52) U.S. Cl. ..... 366/208; 366/241; 422/553

(58) Field of Classification Search ..... 366/108–117, 366/208–219, 124, 128, 314, 241; 422/552–553
See application file for complete search history.

(56) References Cited

U.S. PATENT DOCUMENTS

| | | | | |
|---|---|---|---|---|
| 3,310,292 | A * | 3/1967 | Moore | 366/111 |
| 3,572,651 | A | 3/1971 | Harker | |
| 4,102,649 | A | 7/1978 | Sasaki | |
| 5,558,839 | A * | 9/1996 | Matte et al. | 422/552 |
| 6,176,609 | B1 | 1/2001 | Cleveland et al. | 366/273 |
| 6,357,907 | B1 | 3/2002 | Cleveland et al. | 366/273 |
| 6,482,363 | B1 * | 11/2002 | Dobelin | 422/509 |
| 7,070,740 | B1 * | 7/2006 | Matson et al. | 422/552 |
| 7,338,199 | B2 * | 3/2008 | Hafner | 366/208 |
| 7,648,095 | B2 * | 1/2010 | Jagle | 241/172 |
| 7,784,722 | B2 * | 8/2010 | Jagle | 241/172 |
| 8,084,271 | B2 * | 12/2011 | Korpela et al. | 436/177 |
| 2002/0118594 | A1 | 8/2002 | Vellinger et al. | 366/116 |
| 2006/0087911 | A1 * | 4/2006 | Herz et al. | 366/101 |
| 2006/0245298 | A1 * | 11/2006 | Jagle | 366/244 |
| 2009/0294561 | A1 * | 12/2009 | Jagle | 241/46.06 |
| 2010/0034048 | A1 * | 2/2010 | Jagle | 366/118 |

FOREIGN PATENT DOCUMENTS

| | | | |
|---|---|---|---|
| EP | 0 281 958 | A2 | 9/1988 |
| EP | 281958 | A2 * | 9/1988 |
| EP | 1201297 | A1 * | 5/2002 |
| FR | 2 289 094 | | 5/1976 |
| WO | WO 2004/008154 | A1 | 1/2004 |

* cited by examiner

*Primary Examiner* — Charles E Cooley

(74) *Attorney, Agent, or Firm* — Volpe and Koenig, P.C.

(57) ABSTRACT

A microtiter plate (1), which can be used in a device G, comprises a plurality of receptacles (2) disposed next to one another for a substance or fluid to be stirred and analyzed, wherein stirring rods (3) are provided for stirring. So as to drive these stirring rods, it is provided that the bottoms (4) of the individual receptacles (2) are displaceable and deflectable and that a stirring rod (3) penetrates each of them centrally, the rod being seized by a drive on an outer section (3*b*) protruding downward beyond the bottom (4) such that it can be set into a back and forth motion or a gyrating or rotary motion and thus continues the desired stirring motion on the inside of the receptacle (2).

21 Claims, 4 Drawing Sheets

MICROTITER PLATE WITH STIRRING ELEMENTS

CROSS-REFERENCE TO RELATED APPLICATIONS

This application claims the benefit of German patent application 10 2006 030 056.4, filed Jun. 29, 2006, herein incorporated by reference.

The invention relates to a microtiter plate, having a plurality of receptacles, located side by side, for receiving substances to be mixed and/or stirred and examined, and having stirring elements, and a stirring element is located in individual receptacles of the microtiter plate or all the receptacles above their base, and having a drive mechanism for the stirring elements.

Such microtiter plates are already known.

From U.S. Pat. Nos. 6,176,609 B1 and 6,357,907 B1, an arrangement is known in which stirring elements in individual receptacles are rods that react to magnetic forces and that are movable by one or more magnets or a magnetic field such that a stirring motion takes place inside the receptacles. To that end, one such stirring element reacting to magnetic force must accordingly be inserted into each of the individual receptacles, specifically from above, which is complicated and can lead to contaminations. Moreover, the stirring elements must be removed after the stirring process, so that some of the substance to be examined adheres to them and is carried with them, and at the same time there is the danger that a substance dripping off will get into the "wrong" receptacle and falsify the result there. Moreover, since they are relative expensive these stirring elements must be cleaned so that they can be re-used, so it would be wasteful to discard them after only one use.

From U.S. Pat. No. 4,102,649, a comparable microtiter plate is known, with many receptacles that are to be set in vibration in order to attain a stirring or mixing effect. Accordingly, stirring elements are not provided.

From International Patent Disclosure WO 2004/008154 A1, an arrangement is known in which a microtiter plate is likewise acted upon by vibrational motions. For viscous fluids, stirring pins carried by a stirring pin plate can additionally engage the individual receptacles from above.

SUMMARY OF THE INVENTION

It is therefore the object to create a microtiter plate of the type defined at the outset in which the substances or fluids located in the receptacles can be stirred without the aid of magnetic forces.

For attaining this object, the microtiter plate defined at the outset, with stirring elements and a drive mechanism, is characterized in that the bases of the receptacles in the microtiter plate are resilient and/or deformable; and that as the stirring element, a stirring rod joined to the respective base and/or penetrating it is present, which with a first portion extends from the deflectable base of the receptacle into its interior and with a second portion extends, in particular, downward from the base to outside the receptacle; and that in the position for use, the second portion, located outside the receptacle, of the stirring rod is acted upon by the drive mechanism.

Thus as the base of the receptacle or receptacles of the microtiter plate, a kind of diaphragm or a resilient and deformable part is provided, so that the stirring rod, oriented from the outside inward, on being acted upon by the drive mechanism can execute a reciprocating or tumbling motion that leads to the desired stirring motion in the interior of the receptacle. One common drive mechanism can set some or all of the stirring rods into this kind of stirring or tumbling motion, so that the stirring process is independent of magnetic forces. A tumbling motion can be brought about by a circling drive on the second portion, located outside the receptacle, of the stirring rod, while a reciprocating motion can be brought about by a suitable orientation of the drive motion on this second portion. In the aforementioned tumbling motion of the various stirring rods, which because of the common drive are moved synchronously, the two portions each practically describe a cone, and the tips of the two cones face toward one another and are located in the region of the base. If the first portion in the interior of the receptacles is longer than the second portion located outside the receptacles, then a suitably great boosted stirring motion can be generated with the aid of a relatively small driving motion.

For the stirring motions of the individual stirring rods, it is especially favorable if the bases of the individual receptacles are embodied resiliently and/or as movable diaphragms by means of material weakening and/or by selection of the material forming them. Manifold versions of movable diaphragms are known, so there is a high level of experience in producing and using such diaphragms.

The stirring rods can be joined to the bases in one piece or clamping fashion and/or by positive engagement. Above all when produced from plastic, a one-piece design is possible, but the stirring rods may also be joined to the diaphragm-like bases in any arbitrary other way, so that the individual receptacles, despite the stirring elements or stirring rods located in them, are tight and remain tight, i.e., leakproof. Because of the connection of the stirring rods to the bases, it is unnecessary to remove them from the receptacles.

It is especially advantageous in this respect that in all the receptacles, for instance 96 of them, of such a microtiter plate, matching stirring conditions and stirring intensities can be achieved, since all the stirring elements or stirring rods located in them have matching dimensions and can perform synchronous stirring motions, which is practically impossible with stirring rods that are inserted loosely into such receptacles and that are moved with the aid of magnetic force.

For the most uniform possible motion of all the stirring rods, it is favorable if the second portions of the stirring rods are acted upon and synchronously drivable by one common drive mechanism.

The second portion of the stirring rods can each, with their ends, engage one recess of a drive element that is movable back and forth and/or in circles relative to the receptacles and parallel to the microtiter plate. Thus in a very simple way, a synchronous simultaneous motion of all the stirring rods of one microtiter plate is possible, even if the microtiter plate has 96 receptacles. All that then has to be provided is a suitably high number of recesses in a corresponding drive element.

The length and the deflection of the second portion of the stirring rods by the drive mechanism can be selected that the first portion of the stirring rods, in its stirring or tumbling motion, is spaced apart from the inner wall of the receptacle. The geometric conditions pertaining on the one hand to the cross section or diameter of the receptacles and on the other to the deflection of the stirring rods can accordingly be selected such that the greatest possible stirring motion takes place inside the receptacle, without causing collisions of the stirring rods with the walls of the receptacles.

For driving the stirring rods in common, a drive plate preferably located in a horizontal but optionally also in an oblique plane, parallel to the underside of the microtiter plate, can be embodied with perforations, which the second portions of the stirring rods, located outside the receptacles, loosely engage; in use, a parallel relative motion between the drive plate and the microtiter plate is provided. The drive plate has as many perforations as there are stirring rods to be grasped, and the spacings of the perforations correspond to the spacings of the centers of the receptacles of the microtiter plate, if and because the stirring rods are each located in the center, that is, the middle, of the receptacle.

The drive plate can be movable in a closed path or in circles relative to the microtiter plate, and the movable base, in particular embodied as a diaphragm, of the individual receptacles can center the stirring rods in such a way that the apex of their tumbling motions is located in the base.

One embodiment can provide that the drive, or the drive plate having the perforations, is stationary and the microtiter plate is movable relative to it back and forth or in circles, in particular at a constant spacing from the drive plate. In this way, the aforementioned relative motion between the drive plate and the microtiter plate can be achieved.

However, an embodiment in which the microtiter plate is stationary and the drive plate executes the described relative motions, which are effected by a drive mechanism, is preferable.

The base and/or the diaphragm forming it can be retroactively mounted, injection-molded and/or glued onto, or embodied in one piece with, the microtiter plate and in particular also with the stirring rods. The result is accordingly a very simple part, making this kind of microtiter plate also suitable as a disposable article and thus avoiding the effort and expense of later cleaning.

The microtiter plate and/or the stirring rods and the bases of the receptacles can comprise or consist of plastic, in particular injection-moldable plastic, such as polypropylene. This makes one-piece production possible.

Its receptacles can be provided with a reopenable closure, for instance with a sheet or plate that closes all the receptacles or groups of receptacles or individual receptacles. Thus contaminations of the content of the receptacles are avoided.

For a low-friction driving motion, it is advantageous if the perforations of the drive plate are embodied as tapering conically down to a minimum dimension in the insertion direction of the stirring rods, so that the respective stirring rod fits with the end of its second portion into this narrowest point of the drive perforation, and the tapering of the perforation is embodied with an obliquity that corresponds to or exceeds the oblique deflection of the stirring rod in the stirring process. The coupling openings or perforations in the drive plate are thus expediently adapted to the motion of the second portions of the stirring rods.

It should also be mentioned that a shaking drive can be superimposed on the stirring rod, and for shaking the microtiter plate provided with stirring rods, the drive for the stirring rods can have an imbalance. However, in addition it is also possible simply to provide the entire arrangement with not only the stirring drive but also a separate shaking drive.

A favorable embodiment of the microtiter plate of the invention can provide that the length of the first portion of at least one or some or all of the stirring rods is selected such that in the stirring motion, the stirring rod or rods touch the inner wall of the associated receptacle. As a result, the stirring effect can be enhanced, and the situation in which the boundary layer may be uninvolved or only inadequately involved in the stirring process at the inner wall of the receptacles can be avoided.

It is especially favorable if at least the free end of the first portion or portions is elastically flexible and can be pressed over part of its length against the inner wall of the associated receptacle. In this way, a sliding, rubbing and/or scraping action in the stirring motion can be executed by the stirring rod or stirring rods, so that the stirring process simultaneously assures that if at all possible no significant components remain stuck to the inner wall of the receptacle.

At least the second portion of the stirring rod can be rigid for its cooperation with the drive, and in particular it can have a larger cross section than the free end of the first portion. Thus despite the resilience of the operative part of the first portion of the stirring rod, good transmission of the driving forces to the stirring rod is attained.

The end near the base of the first portion of the stirring rod or stirring rods can have a larger cross section than its free, flexible end; and the flexible end of the first portion can be in particular longer than the end near the base, in particular being approximately twice, three times, four times, five times, six times, seven times, to approximately ten times or twelve times as long. The end of the first portion of the stirring rod that is near the base and thus near the drive can accordingly, like the second portion of the stirring rod, be relatively rigid, for good transmission of the driving forces, while the continuation of this initially relatively thick stirring rod portion can have a lesser cross section toward the free end and as a result can have the desired flexibility. For instance, this thinner, flexible part of the first portion can have approximately the same cross-sectional dimension and elasticity as a plastic bristle.

It should also be noted that a particular advantage of the movable drive and the stationary microtiter plate is considered to be that the microtiter plate can be inserted or removed from the mount by robots or other mechanical grippers, since it always has its place at the same point of the entire unit. Moreover, the masses to be moved are less when the microtiter plate is stationary and the drive plate is moved.

BRIEF DESCRIPTION OF THE DRAWINGS

Exemplary embodiments of the microtiter plate are described in further detail below in conjunction with the drawings. In the drawings, which are partially schematic.

DETAILED DESCRIPTION OF THE PREFERRED EMBODIMENTS

Figure 1:
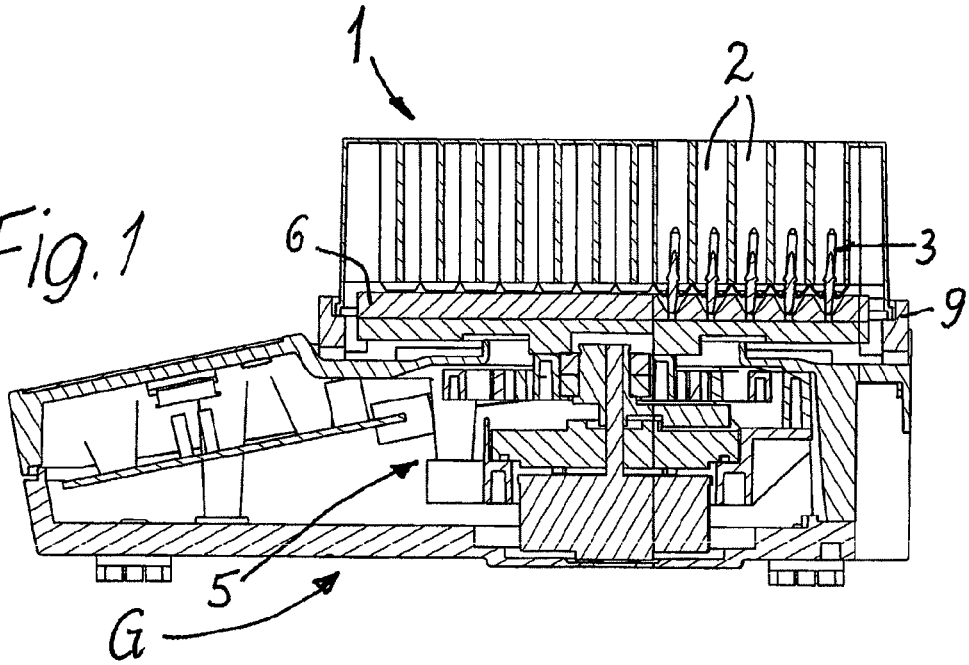
FIG. 1 is a longitudinal section through a microtiter plate of the invention with a drive mechanism, along the section line 1-1 in FIG. 2.
Figure 2:
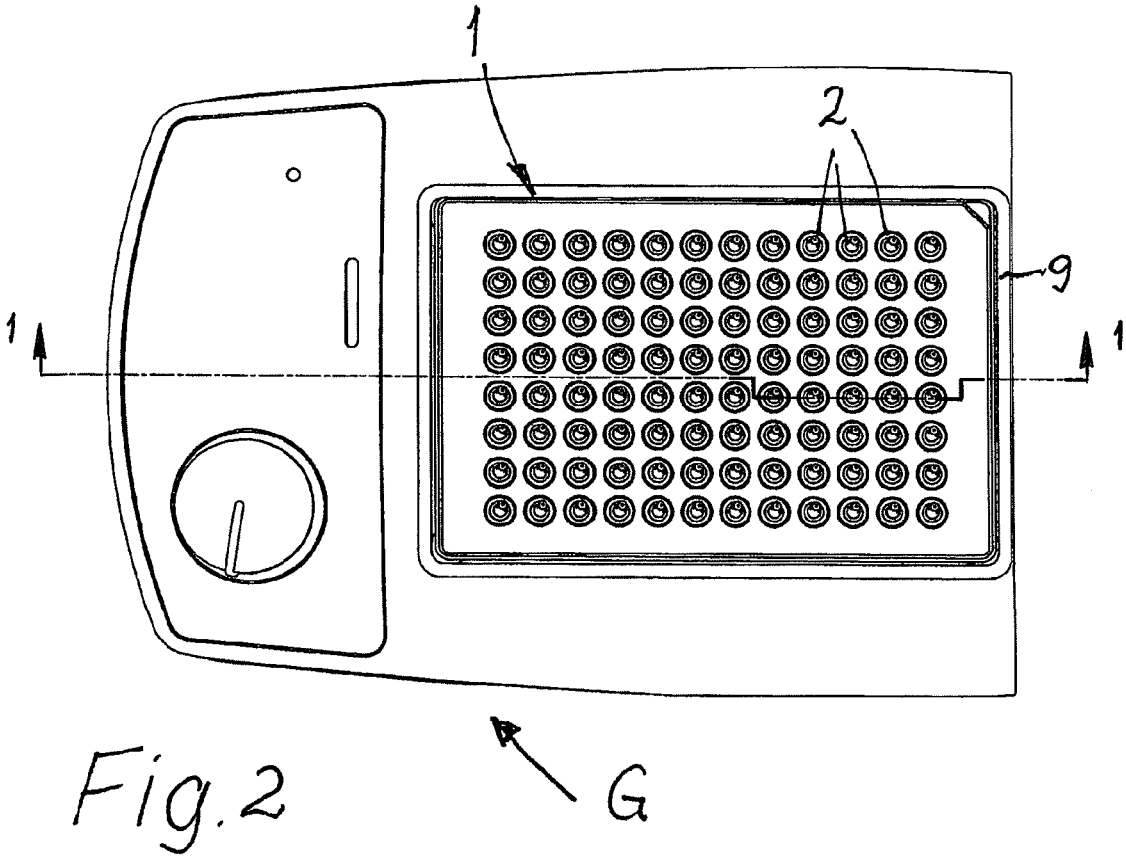
FIG. 2 is a plan view on the microtiter plate and the housing of its drive mechanism, with the microtiter plate in the position for use.
Figure 3:
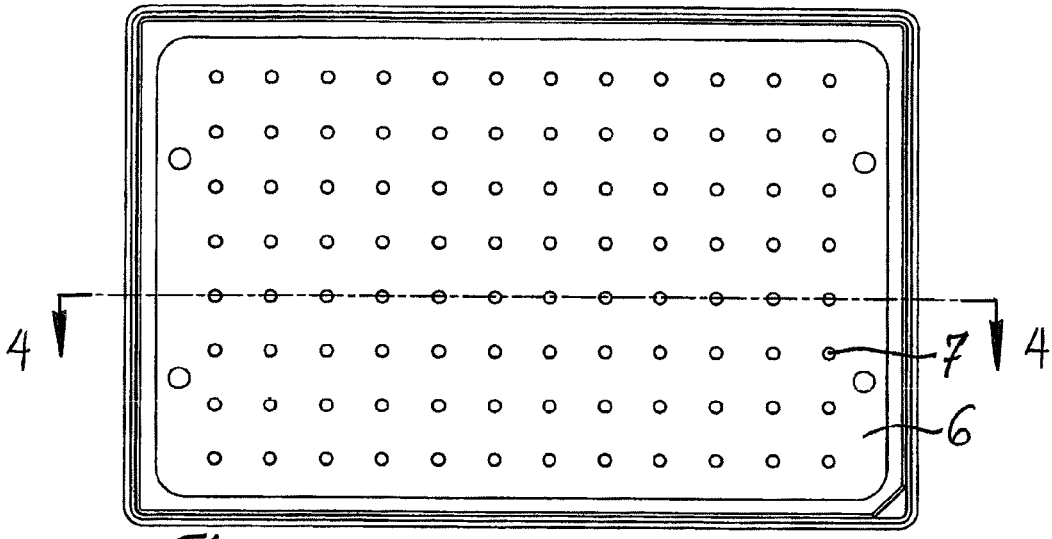
FIG. 3 is a view of the underside of a drive plate, belonging to the drive mechanism, and of the microtiter plate located above the drive plate.
Figure 4:
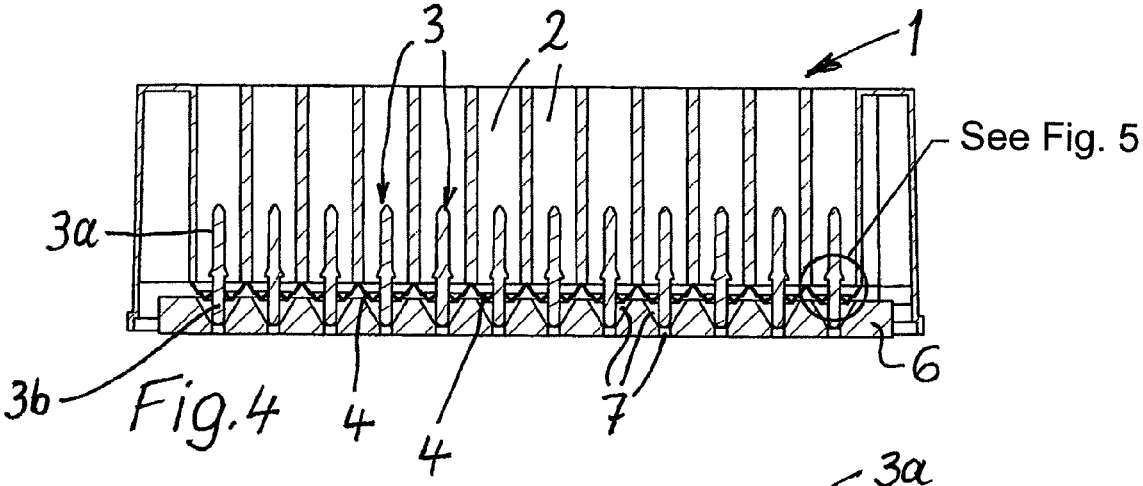
FIG. 4 is a longitudinal section through the microtiter plate and the drive plate, which acts on stirring rods that protrude into the receptacles of the microtiter plate, along the section line 4-4 in FIG. 3.
Figure 10:
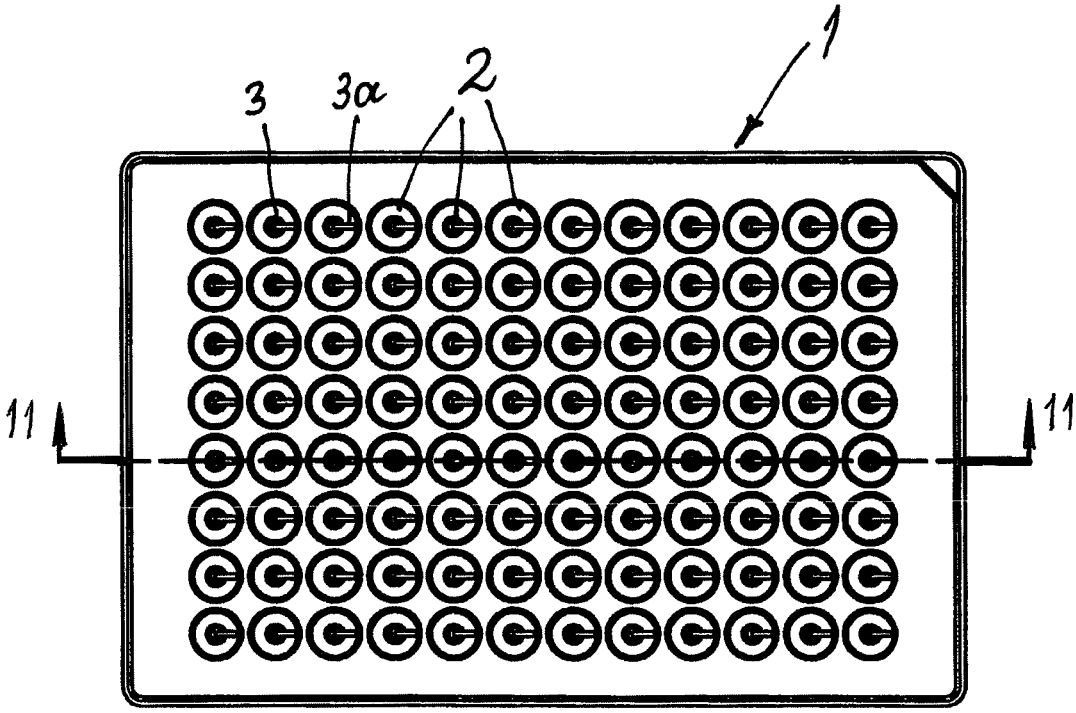
FIG. 10 is a top view through a modified embodiment of a microtiter plate of the invention, having stirring rods sliding, rubbing and/or scraping on the inside of the receptacles.

A piece of equipment G, shown in FIGS. 1 and 2, especially for laboratories or examinations, has as its essential part a microtiter plate 1, which is provided in the usual way with many receptacles 2, located side by side, for receiving substances or fluids to be mixed and/or stirred and examined. In FIGS. 2 and 10, these receptacles 2 are arranged in a manner known per se in eight rows, each of twelve such receptacles 2, so that this total of 96 receptacles forms a rectangle which is located inside the likewise rectangular outline of the microtiter plate 1.

In each of the receptacles 2, stirring elements in the form of stirring rods 3 are provided, which serve to perform the mixing and stirring process and each extend upward above the bases 4 of the receptacles 2, so that a substance located in the receptacles 2 can be acted on by these stirring rods 3.

From FIG. 1 above all, a drive mechanism 5 to be described hereinafter can also be seen, with which the stirring elements can be moved, in particular synchronously.

Figure 5:
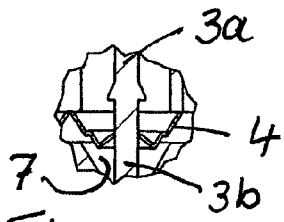
FIG. 5, on a larger scale, shows the detail marked by the indicated circle in FIG. 4, namely the passage of a stirring rod through a base that is movable or embodied as a diaphragm of a receptacle of the microtiter plate.
Figure 7:
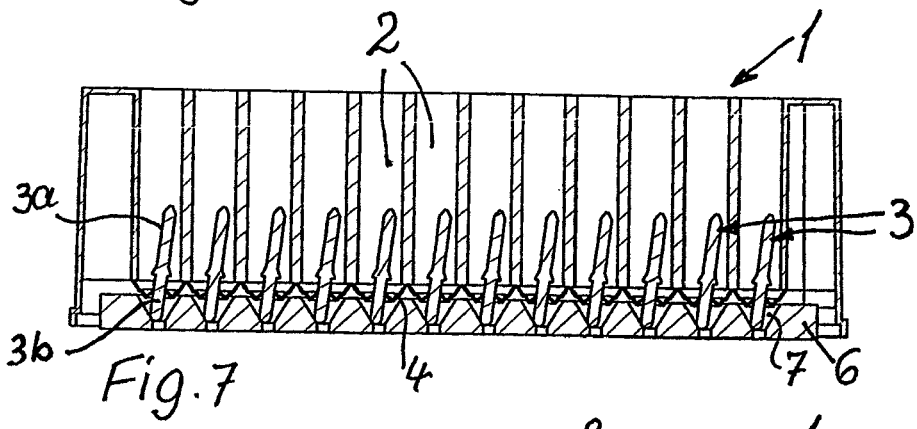
FIG. 7 is a view corresponding to FIG. 6 after a further relative motion, by which the stirring rods have been deflected oppositely to the position in FIG. 6.
Figure 8:
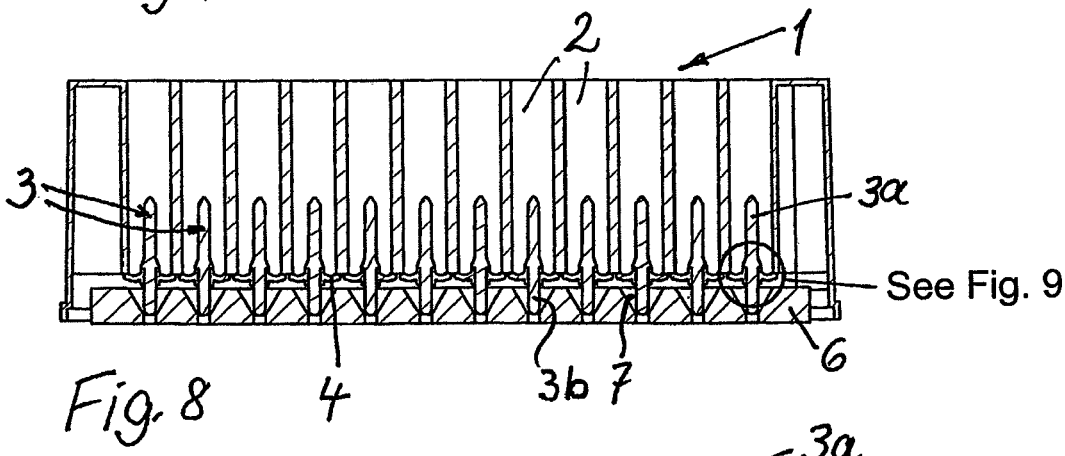
FIG. 8 is a view corresponding to FIG. 4, in which the resilient or movable base, penetrated by the respective stirring rod, is later joined to the microtiter plate or to the receptacles.
Figure 9:
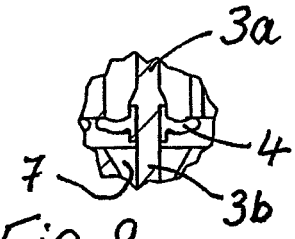
FIG. 9, on a larger scale, shows the detail marked by the indicated circle in FIG. 8 with a clearer illustration of the movable base, penetrated by the stirring rod, of a receptacle of the microtiter plate.

Above all in FIGS. 4 through 9 and 11, and especially well in FIGS. 5 and 9, it can be seen that the bases 4 of the receptacles 2 in the microtiter plate 1 are resilient and deformable by means of material weakening or by a selection of the material forming them, and this can be seen above all by comparing FIGS. 4, 6, 7 and 11.

As the stirring element, a stirring rod 3 joined to and penetrating the respective base 4 at its middle or center is provided, which with a first portion 3*a* extends vertically upward from the base 4 of the receptacle 2 of the microtiter plate 1 into its interior and in this exemplary embodiment extends approximately vertically upward, and with a second portion 3*b* extends downward from the base 4 to outside the receptacle 2. This second portion 3*b* of the stirring rod 3, located outside the receptacle 2, is acted upon in the position for use by the drive mechanism 5 in a manner to be described hereinafter, so that it can be deflected, which leads to a deflection of the portion 3*a* and thus to an stirring motion inside the respective receptacle 2.

The bases 4 of the individual receptacles 2 may be embodied as movable diaphragms, and these diaphragms may be provided continuously for all the receptacles or one on each receptacle individually (FIG. 9).

The stirring rods 3 can be joined to the bases 4 in one piece or by clamping and/or positive engagement, the last being indicated above all in FIG. 9.

Figure 6:
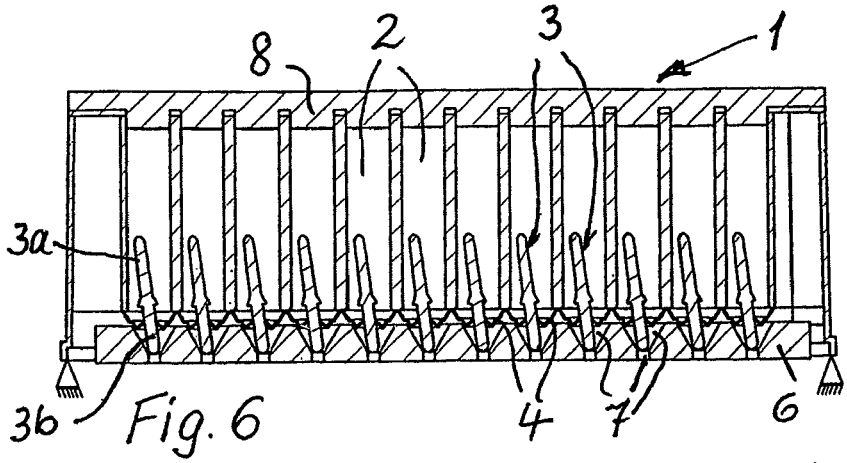
FIG. 6 is a view corresponding to FIG. 4, in which the drive plate has executed a horizontal relative motion relative to the microtiter plate, as a result of which the stirring rods acted upon by the drive plate have been deflected toward the left in terms of FIG. 6, specifically by their first portion, located in the receptacles.
Figure 11:
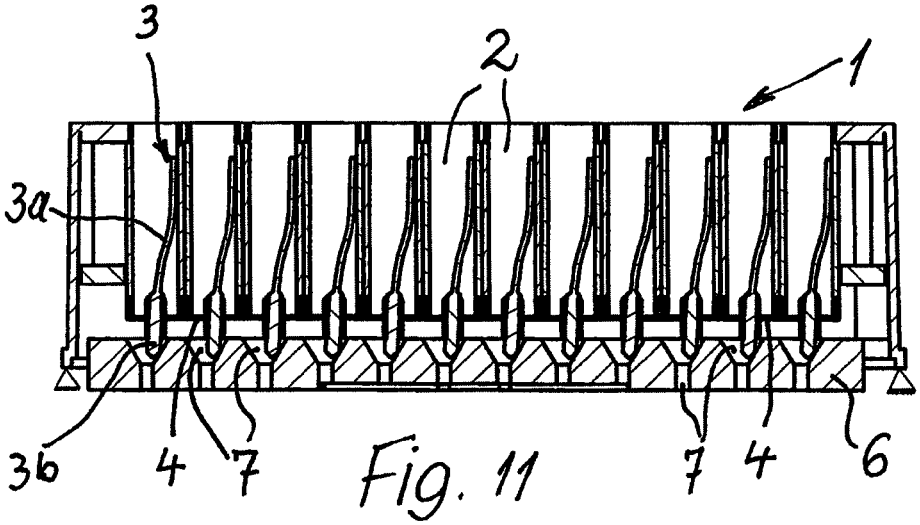
FIG. 11 is a longitudinal section through the modified embodiment of a microtiter plate of the invention, along the section line 11-11 in FIG. 10.

The second portions 3*b* of the stirring rods 3 are acted upon and driven synchronously by the common drive mechanism 5 in order to execute their stirring motion. In FIGS. 3 through 9 and 11, it can be seen that the second portions 3*b* of the stirring rods 3, with their ends, each engage one recess or perforation 7 of a drive element, which element is embodied in the exemplary embodiment as a drive plate 6 and which is movable back and forth and/or in circles relative to the receptacles 2, parallel to the microtiter plate 1, in order to effect the deflections of the stirring rods 3 as shown in FIGS. 6, 7 and 11.

The length and the deflection of the second portion 3*b* of the stirring rods 3 is selected, in the exemplary embodiments of FIGS. 4 through 8, such that the first portion 3*a* of the stirring rods 3, in its stirring or tumbling motion, maintains a spacing from the inner wall of the receptacles 2, as can be seen clearly in FIGS. 6 and 7.

For the common drive of the stirring rods 3, as already mentioned, as the drive element, the drive plate 6 located in a horizontal plane parallel to the underside of the microtiter plate 1, can be provided with perforations 7 as coupling recesses, which are loosely engaged by the second portions 3*b*, located outside the receptacles 2, of the stirring rods 3, so that no complicated coupling devices are needed. By mounting the microtiter plate, with the stirring rods 3 joined to it via the bases 4, on its retaining frame 9 or retention place on the equipment G, the coupling to the drive plate 6 and its perforations 7 takes place automatically. In use, a parallel relative motion then takes place between the drive plate 6 and the microtiter plate 1, in order to deflect the stirring rods 3 in the manner described and thereby bring about the stirring process.

On comparing the drawing figures, it becomes clear that in the exemplary embodiments shown, which differ somewhat in the design of the bases 4, during the stirring motion the microtiter plate 1 is stationary while the drive plate 6 is movable. The drive plate 6 is movable in a closed path or in a circle or back and forth relative to the microtiter plate 1, and the movable base 4, embodied as a diaphragm, of the individual receptacles 2 centers the stirring rods 3 in such a way that the apex of their tumbling motions, or also of their motions back and forth, is located precisely at or in this base 5. Above all in FIGS. 4, 8 and 11, it can be seen that the stirring rods are located in the center or the middle of the receptacles 2, which as a rule are cylindrical.

At this point, it should be noted that it would also be conceivable for the drive plate 6 that has the perforations 7 to be stationary and for the microtiter plate 1 to be movable relative to it back and forth or in circles, particular at a constant spacing from the drive plate 6. By the selected arrangement, however, with the microtiter plate 1 stationary during the stirring process, the advantage is obtained that this microtiter plate 1 can be moved and inserted and removed again from the equipment G with the aid of mechanical manipulating devices or robot arms.

The base 4, or the diaphragm forming it, can be mounted, injection-molded, or glued retroactively to the individual receptacles 2 of the microtiter plate 1, as indicated in FIG. 9, or it can be injection-molded in one piece with the microtiter plate 1 and optionally with the stirring rods 3 as well. The microtiter plate 1, stirring rods 3 and bases 4 of the receptacles 2 all comprise plastic, which can expediently be injection-molded, as is the case for polypropylene.

In the manner indicated in FIG. 6, the receptacles 2 can be provided with a reopenable closure 8, in order to shield the interior of the receptacles 2 from the surroundings. Here, the closure 8 is in the shape of a plate that reaches partway into the receptacles 2 and can be raised.

The perforations 7 in the drive plate 6 are embodied tapering conically from top to bottom down to a minimum dimension in the direction in which the stirring rods extend, and from that minimum dimension, they then pass through the entire drive plate 5 in this exemplary embodiment. In this way, the second portions 3*b* of the stirring rods 3 are each grasped at the narrowest point of these drive perforations 7 and are centered automatically upon insertion of the microtiter plate. The taper of the perforations 7 is designed with an obliquity that is approximately equivalent to the oblique deflection of the respective stirring rod 3, or even exceeds this in FIGS. 6, 7 and 11, so that even in the deflected state, the portions 3*b* of the stirring rods 3 are largely freely movable.

In FIGS. 10 and 11, an exemplary embodiment of the microtiter plate 1 with stirring rods 3 is shown that is largely equivalent to the exemplary embodiments described above in terms of the drive and mode of operation, and that therefore has the same reference numerals for parts that agree in terms of function and operation.

In a departure from the exemplary embodiments described above, however, it is provided that the length of the first portion 3*a* of the stirring rods 3—in contrast to the arrangement of FIGS. 6 through 8—is selected such that in the stirring motion, the stirring rods 3 touch the inner wall of the associated receptacles 2. It can be seen in FIG. 11 that the free end of the first portions 3*a* of the stirring rods 3 is elastically flexible and can be pressed over a part of its length against the inner wall of the associated receptacles 2, so that the stirring process is made more effective and the boundary layer at the inner wall of the receptacles 2 can also be engaged by the stirring rod 3 and its first portion 3*a*, even if the stirring motion has created a funnel or eddy in the fluid.

At the same time, it can be seen from FIG. 11 that the second portion 3*b* of the stirring rod 3 is rigid, for cooperation with the drive plate 6 and its perforation, and has a larger cross section than the free, flexible end, which conforms to the wall of the receptacle 2, of the first portion 3*a*. Thus despite the resilient design of the first portion 3*a* of the stirring rod 3, good transmission of the driving forces to that portion can be accomplished.

The end near the base of the first portion 3*a* of the stirring rods 3 likewise has a larger cross section than its free, flexible end, which is also clearly seen from FIG. 11. This flexible end of the first portion 3*a* can be longer than the end near the base 4 of this first portion 3*a*, and this flexible end can be approximately twice, three times, four times, five times, six times, seven times to ten times or even twelve times as long as the nonflexible or more-rigid part of this first portion 3*a*. Equally well, the stirring rod 3 can be made to press with its flexible part of the first portion 3*a* slidingly, rubbingly, and/or scrapingly against the inner wall of the receptacles 2, in order to achieve an intense processing of the product located in the receptacles 2. Moreover, as a result, later cleaning of the microtiter plate 1 can be simplified, since there are fewer residues on the inner wall of the receptacles 2.

The microtiter plate 1, which can be used in a piece of equipment G, has many receptacles 2, located side by side, for a substance or fluid that is to be stirred and examined, and stirring rods 3 are provided for the stirring. For driving these stirring rods, it is provided that the bases 4 of the individual receptacles 2 are movable and deflectable and are penetrated centrally each by a respective stirring rod 3, which is grasped by a drive with an outer portion 3*b*, protruding downward past the bases 4, so that it can be set into a back-and-forth motion or a tumbling or circling motion and thus performs the desired stirring motion in the interior of the receptacle 2.

Since the drive becomes operative from the underside of the microtiter plate 1, the top side of the microtiter plate remains freely accessible, so that even the closure 8 that is visible in FIG. 6 can be mounted or lifted away readily and conveniently.

What is claimed is:

1. A microtiter plate (1), comprising a plurality of receptacles (2), located side by side, for receiving substances to be mixed and/or stirred and examined, and having stirring elements, and one of the stirring elements is located in individual ones of the receptacles or all the receptacles above their base (4), and having a drive mechanism (5) for the stirring elements, the bases (4) of the receptacles (2) in the microtiter plate (1) are resilient and/or deformable; and as the stirring element, a stirring rod (3) at least one of joined to the respective base (4) or penetrating the respective base (4) is provided, a first portion (3*a*) of the stirring rod (3) extends from the base (4) of the receptacle (2) into an interior thereof and a second portion (3*b*) of the stirring rod (3) extends from the base (4) to outside the receptacle (2); and in a position for use, the second portion (3*b*), located outside the receptacle (2), of the stirring rod (3) is acted upon by the drive mechanism (5).

2. The microtiter plate as defined by claim 1, wherein the bases (4) of the individual receptacles (2) are embodied at least one of resiliently or as movable diaphragms by at least one of a material weakening or by selection of the material forming the bases (4).

3. The microtiter plate as defined by claim 1, wherein the stirring rods (3) are at least one of adjoined in one piece or in clamping fashion or by positive engagement to the bases (4).

4. The microtiter plate as defined by claim 1, wherein the second portions (3*b*) of the stirring rods (3) are acted upon by the drive mechanism (5) and are drivable synchronously.

5. The microtiter plate as defined by claim 1, wherein the second portions (3*b*) of the stirring rods (3) include ends, and each of the ends engage one recess in a drive element connected to the drive mechanism that is movable at least one of back and forth or in a circle relative to the receptacles (2) parallel to the microtiter plate (1).

6. The microtiter plate as defined by claim 5, wherein as the drive element for common driving of the stirring rods (3), a drive plate (6) located in a horizontal plane parallel to the underside of the microtiter plate (1) is provided, having perforations which are engaged by the second portions (3*b*), located outside the receptacles (2), of the stirring rods (3), and in use, a parallel relative motion between the drive plate (6) and the microtiter plate (1) is provided.

7. The microtiter plate as defined by claim 6, wherein the drive plate (6) is movable relative to the microtiter plate (1) in a closed path or in a circle; and the movable base (4) of the individual receptacles (2) centers the stirring rods (3) in such a manner that an apex of tumbling motions thereof is located in the base (4).

8. The microtiter plate as defined by claim 6, wherein the drive plate (6) that has the perforations (7), is stationary, and the microtiter plate (1) is movable relative to the drive plate (6) back and forth or in circles.

9. The microtiter plate as defined by claim 6, wherein the perforations (7) of the drive plate (6) are embodied as tapering conically down to a minimum dimension in an insertion direction of the stirring rods (3), so that the respective stirring rod fits with the end of the second portion into the minimum dimension of the drive perforation (7), and the tapering of the perforation (7) is embodied with an obliquity that corresponds to or exceeds an oblique deflection of the stirring rod (3).

10. The microtiter plate as defined by claim 6, wherein during the stirring motions, the microtiter plate (1) is stationary and the drive plate (6) is movable parallel to the microtiter plate.

11. The microtiter plate as defined by claim 1, wherein a length and a deflection of the second portion (3*b*) of the stirring rods (3) by the drive mechanism are selected such that the first portion (3*a*) of the stirring rods (3), during a stirring or tumbling motion thereof, is spaced apart from an inner wall of the receptacles (2).

12. The microtiter plate as defined by claim 1, wherein at least one of the base (4) or a diaphragm forming the base is at least one of retroactively mounted, molded or glued onto, or embodied in one piece with, the microtiter plate (1) and the stirring rods (3).

13. The microtiter plate as defined by claim 1, wherein at least one of the microtiter plate (1) or the stirring rods (3) and the bases (4) of the receptacles (2) comprise plastic.

14. The microtiter plate as defined by claim 1, wherein the receptacles (2) are provided with a reopenable closure (8), that closes all the receptacles or groups of the receptacles (2).

15. The microtiter plate as defined by claim 1, wherein a shaking drive is superimposed on the stirring drive.

16. The microtiter plate as defined by claim 1, wherein for shaking the microtiter plate provided with stirring rods, the drive for the stirring rods has an imbalance.

17. The microtiter plate as defined by claim 1, wherein the stirring rods (3) have matching dimensions.

18. The microtiter plate as defined by claim 1, wherein a length of the first portion (3*a*) of at least one or some or all of the stirring rods (3) is selected such that in the stirring motion, it touches an inner wall of the associated receptacle (2).

19. The microtiter plate as defined by claim 1, wherein at least a free end of the first portion (3*a*) of the stirring rod (3) is elastically flexible and can be pressed over at least part of a length thereof against an inner wall of the associated receptacle (2).

20. The microtiter plate as defined by claim 1, wherein at least the second portion (3*b*) of the stirring rod (3) is rigid and has a larger cross section than the free end of the first portion (3*a*).

21. The microtiter plate as defined by claim 1, wherein an end near the base (4) of the first portion (3*a*) of the stirring rod or rods (3) has a larger cross section than a free, flexible end thereof; and the flexible end of the first portion (3*a*) is longer than an end near the base (4).

* * * * *